US005414885A

United States Patent [19]

Berlin et al.

[11] Patent Number: 5,414,885

[45] Date of Patent: May 16, 1995

[54] TRANSPORTABLE BRIDGE

[75] Inventors: Hans-Joachim Berlin, Duisburg; Wolfgang Diefendahl, Straelen; Johann Matuschek, Kerken, all of Germany

[73] Assignee: Krupp Fordertechnik GmbH, Duisburg, Germany

[21] Appl. No.: 160,871

[22] Filed: Dec. 3, 1993

[30] Foreign Application Priority Data

Dec. 3, 1992 [DE] Germany ..... 42 40 574.2

[51] Int. Cl.[6] ..... E01D 15/12

[52] U.S. Cl. ..... 14/2.4; 14/4; 14/14; 14/73

[58] Field of Search ..... 14/2.4, 2.5, 2.6, 3-8, 14/13-14, 73, 73.1, 15, 77.1; 52/645, 646; 104/125

[56] References Cited

U.S. PATENT DOCUMENTS

| | | | |
|---|---|---|---|
| 3,394,419 | 7/1968 | Sedlacek | 14/13 |
| 4,912,795 | 4/1990 | Johnson | 14/3 |
| 4,965,903 | 10/1990 | Bisch | 14/2.4 |

FOREIGN PATENT DOCUMENTS

| | | | |
|---|---|---|---|
| 734282 | 7/1932 | France | 14/14 |
| 1039088 | 9/1958 | Germany . | |
| 1233897 | 2/1967 | Germany . | |
| 2801945 | 7/1978 | Germany . | |
| 3814502A1 | 11/1989 | Germany . | |
| 761925 | 11/1956 | United Kingdom . | |
| 1121083 | 7/1968 | United Kingdom . | |
| 2074209 | 10/1981 | United Kingdom . | |

*Primary Examiner*—Ramon S. Britts
*Assistant Examiner*—James A. Lisehora
*Attorney, Agent, or Firm*—Spencer, Frank & Schneider

[57] ABSTRACT

A transportable bridge having longitudinal sides, includes plural bridge sections connected in series and presenting first and last bridge sections in the series. Each said bridge section in the series includes a deck slab extending across a width of the bridge and having front and rear transverse ends, and an inverted triangular truss on each longitudinal side of the bridge. Each truss has a lower corner portion and an oppositely disposed top beam. The lower corner portion of the truss is connected to the rear transverse end of the deck slab and additionally to the front transverse end of the deck slab of an adjacent following bridge section in the series of bridge sections. The top beam of the truss of the bridge section is connected to the top beam of the adjacent following bridge section thus forming a trough-shaped bridge having a lateral truss structure. A further deck slab is associated with the last bridge section. Diagonal struts are connected, respectively, between the top beams of the trusses of the first and last bridge sections and the deck slabs associated with the first and last bridge sections for closing off the trusses.

12 Claims, 6 Drawing Sheets

TRANSPORTABLE BRIDGE

CROSS-REFERENCE TO RELATED APPLICATIONS

The present application claims the right of foreign priority with respect to Application No. P 42 40 574.2, filed Dec. 3rd , 1992, in Germany, the disclosure of which is incorporated herein by reference.

BACKGROUND OF THE INVENTION

The present invention relates to a bridge which can be assembled from individual bridge sections.

Transportable and assemblable bridges are known which can provide a path for heavy vehicles, for example, tanks, across and over obstacles such as rivers and ravines. For example, German Unexamined Published Application 38 14 502 discloses a bridge which is assembled from prefabricated, stable bridge sections. However, the known bridge sections are quite heavy and difficult to handle. Thus, they must be transported and assembled using heavy equipment.

SUMMARY OF THE INVENTION

It is an object of the present invention to provide a transportable bridge which can be easily and readily transported in pieces by, for example, aircraft or helicopters.

It is a further object of the present invention to design the bridge pieces so that they may be carried or parachuted into the desired location.

It is yet another object of the present invention to allow for the bridge to be assembled as a self-supporting, projecting structure by relatively few people without using special equipment.

The above and other objects are accomplished according to the invention by the provision of a transportable bridge having longitudinal sides, comprising: plural bridge sections connected in series and presenting first and last bridge sections in the series, each bridge section in the series including: a deck slab extending across a width of the bridge and having front and rear transverse ends; and an inverted triangular truss on each longitudinal side of the bridge, each truss having a lower corner portion and an oppositely disposed top beam, the lower corner portion of the truss being connected to the rear transverse end of the deck slab and additionally connected to the front transverse end of the deck slab of an adjacent following bridge section in the series of bridge sections, and the top beam of the truss of the bridge section being connected to the top beam of the adjacent following bridge section, thus forming a trough-shaped bridge having a lateral truss structure; a further deck slab associated with the last bridge section; and diagonal struts connected, respectively, between the top beams of the trusses of the first and last bridge sections and the deck slabs associated with said first and last bridge sections for closing off the trusses.

Each bridge section, and thus the entire main support system of the bridge, has essentially only two different components, i.e., the deck slabs and the triangular trusses placed thereon. The deck slabs and the triangular trusses are dimensioned to reduce their size and corresponding weight. Preferably, these components are comprised of a material having a low specific mass, for example aluminum. Consequently, the deck slabs and the triangular trusses can be made so light that they can be carried by people, for example, from the place where they were dropped by parachute to the place of their installation. Further, because of the reduced weight of the individual components, the bridge can be manually assembled by relatively few people.

When assembled, the bridge has a trough shape, and consists essentially of longitudinally extending main support walls, and a base of deck slabs. The main support walls of the trough-shaped bridge consist only of the triangular trusses, which are inverted and placed on their tips. The bottom boom of the main support walls are formed by the deck slabs themselves. Only the first and the last bridge sections need an additional component to form a main support wall capable of supporting a load. This additional component is preferably a diagonally arranged strut, and will be described later in detail.

The bridge in accordance with the present invention can be used as a fixed bridge for placement on the banks of a river or ravine. Alternatively, the bridge can be placed on floats and used as a ferry or as a floating bridge. Further, it is possible to add one or more approach ramps to the ends of the bridge in order to facilitate entry onto and off of the bridge.

To eliminate excessive free play between the connected components when the bridge is assembled, the deck slabs and the triangular trusses are interlockingly connected with each other. The interlocking connection includes at least one downwardly projecting peg on the lower corner portion of the truss. Further, the rear transverse end of one bridge section and the front transverse end of a following bridge section includes a securing device extending perpendicularly to the peg. The securing device includes a bore for receiving the peg, whereby the truss lower corner portion, the front transverse end of the following bridge section, and the rear transverse end of the one bridge section are releasably connected together.

Preferably, the interlocking connection occurs by rotating the truss about an axis of the peg. Typically, this angle of rotation is, for example, about 45 degrees. When rotated, a lower corner portion flange interlockingly engages with a securing hook disposed adjacent to the bore.

In a preferred embodiment, the releasable connection of the top beams of the truss occurs by providing each top beam with a hammer or H-shaped projection on one end and a pocket which corresponds to the projection on the other end. When the truss is rotated, the projection of one bridge section top beam is received within the pocket of the following bridge section top beam, whereby the top beams of adjacent bridge sections are interlockingly connected together. One of the first and second ends of the top beam may further include a pivotal clamp for locking the hammer or H-shaped projection within the pocket to prevent the truss from accidently rotating out of position.

To make the deck slabs as light as possible, the surface of the deck slabs can be limited, for example, to two tracks. The two tracks of the deck slab can then be supported by appropriate supports extending over the entire width of the bridge.

To limit the number of loose individual parts, curb pieces, which keep the vehicles aligned with the tracks, are hinged to the top of the deck slabs. The curb pieces can be erected to project above a level of the tracks using a spring, and subsequently supported by props.

The invention will be described below in greater detail in connection with embodiments thereof that are illustrated in the drawing figures.

DETAILED DESCRIPTION OF THE INVENTION

Figure 1:
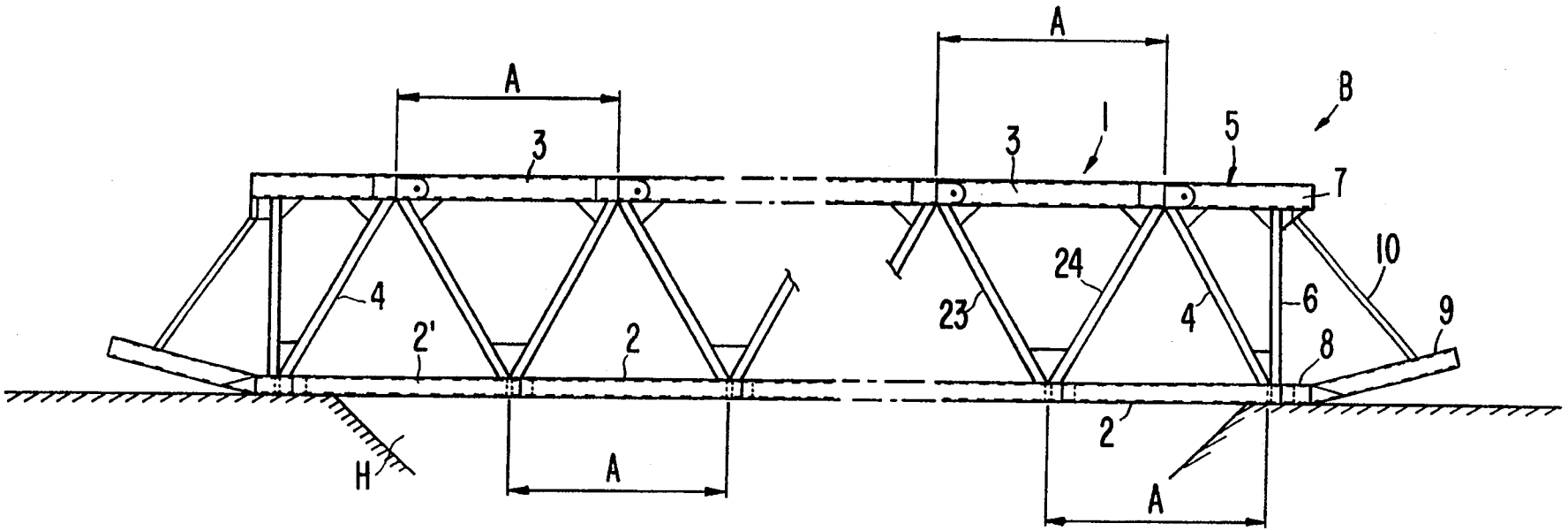
FIG. 1 is an elevational side view of a fixed bridge according to the present invention.

Referring to FIG. 1, there is shown a bridge B assembled from an arbitrary number of bridge sections A. Each bridge section A has an inverted triangular truss 1 on each lateral side (i.e. a total of two inverted trusses per bridge section), and a deck slab 2. Each truss has a top beam 3. When the bridge is assembled, the top beams 3 of adjacent sections abut and are connected with each other in a manner to be described. Two adjacent deck slabs 2 are connected to each other at their abutting transverse edges with a lower tip or corner portion of triangular truss 1.

To complete an assembled bridge, a further deck slab 2' is associated with the last bridge section shown at the left hand side of FIG. 1, and the top beams 3 of the first and last bridge sections are connected, respectively, with the first and last deck slabs 2, 2' by a diagonal strut 4.

Typically, the first and last bridge section will be joined to an entrance/exit section. As shown at the right hand side of FIG. 1, each entrance/exit section is comprised of a support structure 5, which includes a vertical support 6 for supporting a flange 7, which extends in a linear, horizontal direction from top beam 3. Further, the entrance/exit section includes an extension 8 attached to deck 2 (and further deck slab 2' in the case of the last bridge section) for accommodating support 6. An approach ramp 9 may also be provided which is attached to extension 8 with, for example, hinges so that ramp 9 may be raised or lowered. Preferably, one end of ramp 9 is held in the desired raised or lowered position by a pull element 10 which can be adjusted in length. When assembled, bridge B is supported by its respective ends on the banks of an obstacle H.

Figure 2:
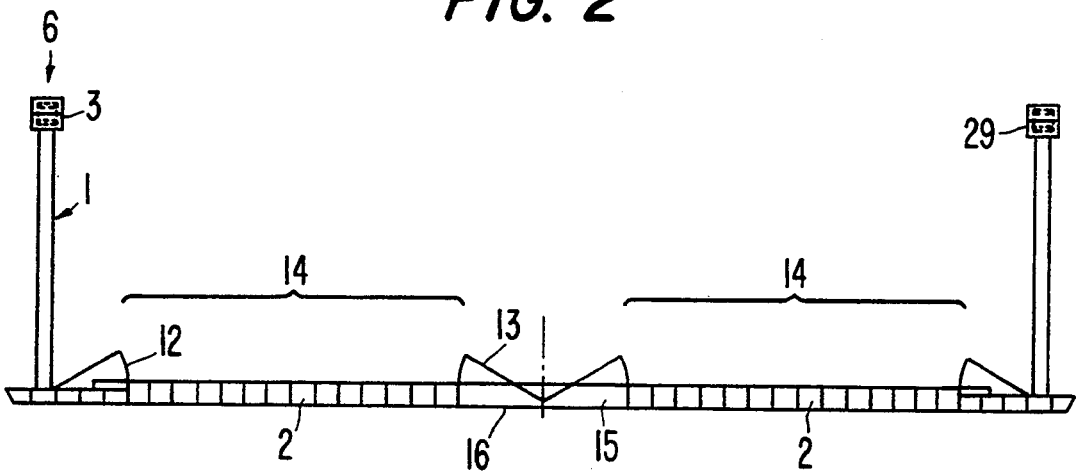
FIG. 2 is a cross sectional illustration of a bridge fixed according to the present invention.

Referring to FIG. 2, deck slab 2 includes curb pieces 12. Curb pieces 12 help to guide the vehicles using the bridge, thus preventing the vehicles from unintentionally swerving. Preferably, each curb piece is hinged at a level of the surface of deck slabs 2 and is pressed upward by a spring (not shown). During transport, the deck slabs will typically be stacked on one another. As long as the deck slabs remain stacked, curb pieces 12 will be pressed level to the deck slab surface. When the deck slabs are separated, the curb pieces 12 are pushed upright into position by the spring force. The curb pieces 12 are maintained in their upright position by individual props 13.

Typically, the deck slab 2 has two flat tracks 14 and one or more cutouts 15 therebetween. Cutouts 15 help to reduce the weight of deck slabs 2, so that the deck slabs may be more easily transported and assembled. Each pair of tracks 14 is supported by individual supports 16 extending over the entire width of the bridge.

Figure 3:
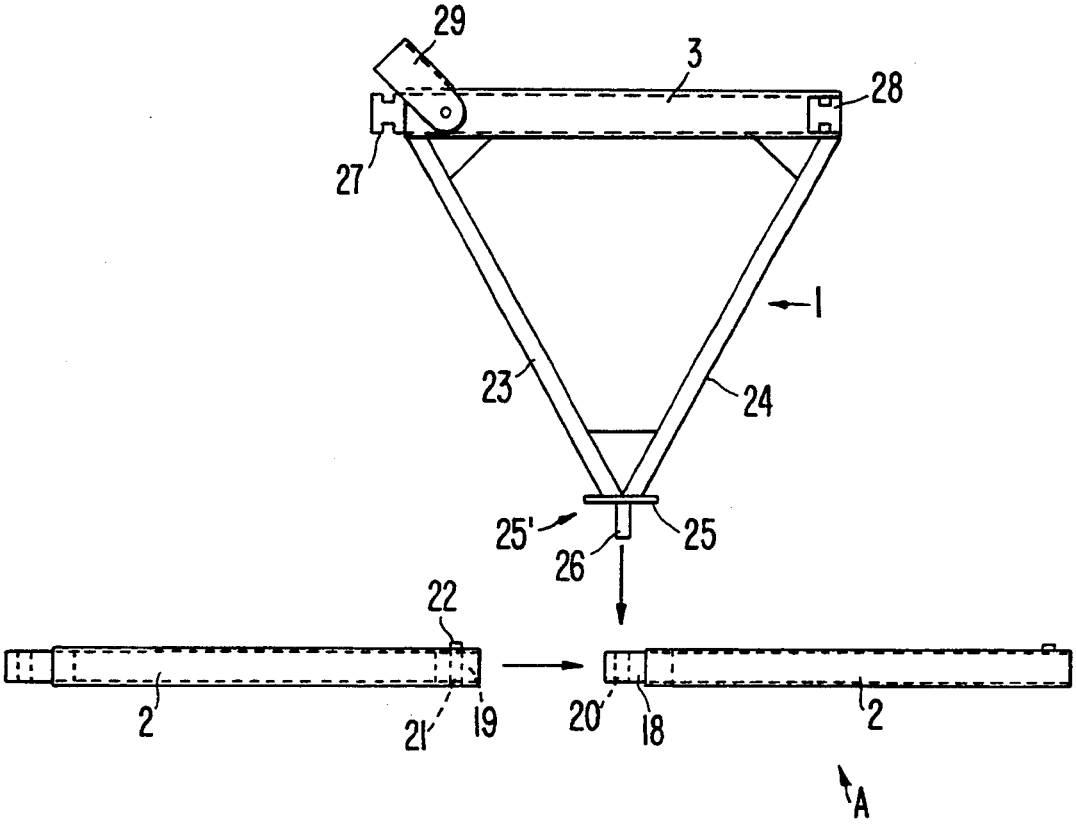
FIG. 3 is an exploded, side elevational illustration of a triangular truss and a deck slab of a leading bridge section together with a deck slab of a following, adjoining bridge section according to the present invention.
Figure 4:
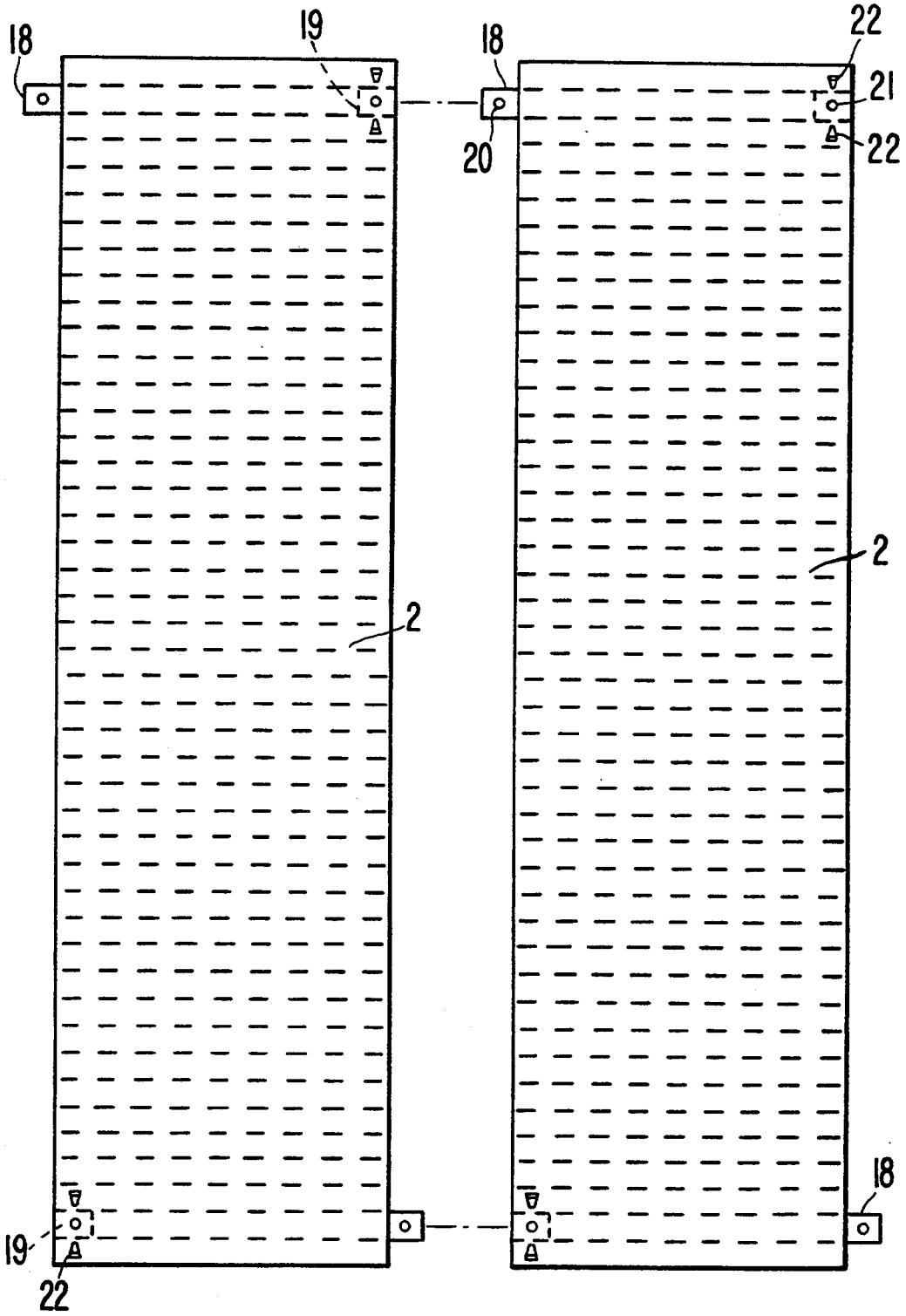
FIG. 4 is an exploded plan view of the deck slabs of two adjoining bridge sections of a preferred embodiment of the present invention.

Referring to FIGS. 3 and 4, two generally rectangular-shaped deck slabs 2 are shown prior to assembly. Each deck slab has a lower flange peg 18 at two diagonally opposed corners. Lower flange peg 18 projects in a direction toward the adjacent deck slab. Each deck slab further has corresponding bottom flange pockets 19 at the remaining two diagonally opposed corners for receiving the lower flange peg 18. Each lower flange peg 18 is penetrated by a bore 20. A corresponding bore 21 likewise penetrates the deck slabs in the region of bottom flange pockets 19. Each bore 20 and 21 is essentially perpendicular to lower flange peg 18. Each deck slab 2 further comprises two securing hooks 22 disposed adjacent to each bore 21 for securing truss 1 to deck slabs 2, as will be subsequently explained.

Each triangular truss 1 further comprise two downward leading diagonal struts 23, 24 fastened at an upper end to top beam 3. Diagonal struts 23 come together at a lower corner portion 25' which includes a horizontal plate or cap 25, and a downwardly projecting peg-like connecting bolt 26. The diameter of connecting bolt 26 is matched to bores 20 and 21. Further, top beam 3 includes an H-shaped projection 27 on one end and a corresponding receiving pocket 28 on an opposite end. One of the ends of top beam 3 includes a pivotal clamp 29 for locking H-shaped projection 27 within pocket 28.

Figure 5:
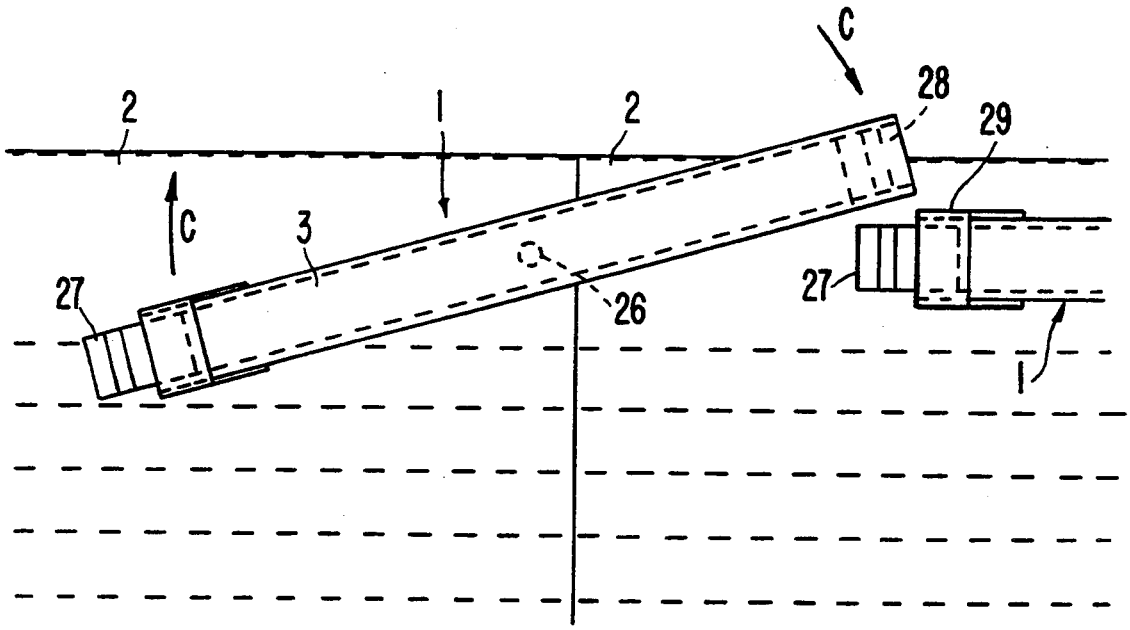
FIG. 5 is a plan view of a preferred embodiment of the present invention illustrating the assembly of a triangular truss to an adjacent truss.
Figure 6:
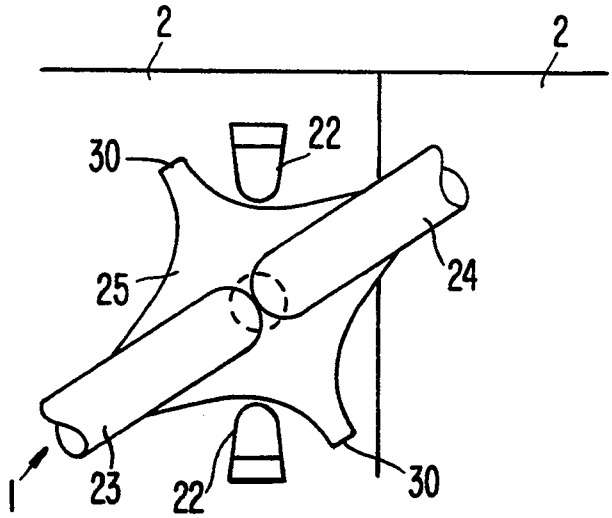
FIG. 6 is a partial plan view of the lower corner portion of a triangular truss during assembly, and the associated deck slabs.

Referring also to FIGS. 5 and 6, bridge B is assembled in sections. First, deck slab 2 of bridge section A and a following deck slab 2 of an adjoining bridge section are pushed together, so that lower flange pegs 18 are inserted into the flange pockets 19. Once inserted, bores 20 and 21 are coaxial to each other. Then, connecting bolt 26 is inserted into bores 20, 21, so that top beam 3 of triangular truss 1 is oriented obliquely relative to the longitudinal direction of the bridge (FIG. 5). When top beam 3 is pivoted in the direction of arrow C into a position parallel to the longitudinal direction of the bridge, two projections 30 of cap 25 come to rest under securing hooks 22, locking the truss, and the two adjacent deck slabs together.

Preferably, during the pivotal motion of top beam 3, receiving pocket 28 is simultaneously pushed onto the corresponding H-shaped projection 27 of the triangular truss of the adjacent bridge section, thus connecting the two adjacent top beams 3 together. This connection is secured, for example, by lowering pivotal clamp 29 over pocket 28 and corresponding H-shaped projection 27 received therein, thereby forming a rigid connection between the triangular trusses and the deck slabs.

Figure 7:
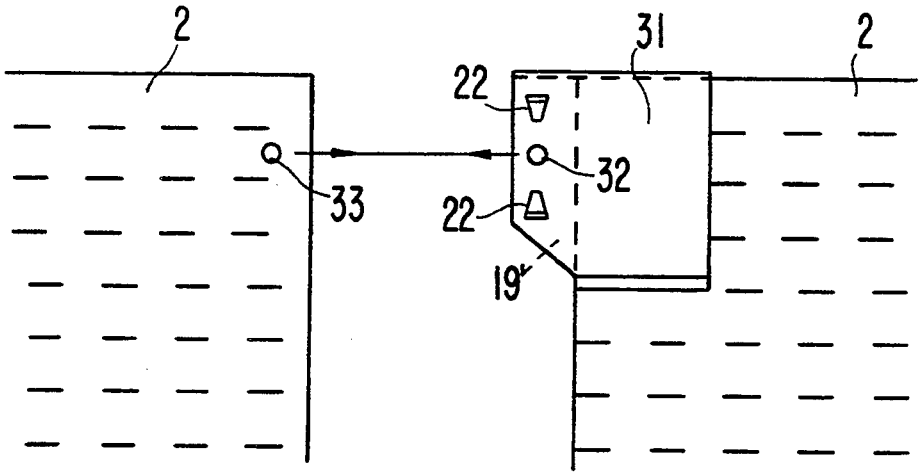
FIG. 7 is an exploded partial plan view of an alternate embodiment of the connection between two adjacent deck slabs of the present invention.

Referring to FIG. 7, an alternate embodiment is shown wherein a pair of metal plates 31 are fastened to opposite surfaces of deck slab 2 and extend beyond the deck slab in a longitudinal direction of the bridge, forming a lower flange pocket 19'. In this embodiment, each lower flange pocket 19' is penetrated by a bore 32 and the adjacent deck slab is penetrated by a corresponding bore 33. Each bore 32 and 33 is essentially perpendicular to lower flange pocket 19'. When assembling two adjacent deck slabs together, the corner of the deck slab with bore 33 is slidingly inserted into flange pocket 19' until bores 32 and 33 are coaxially located. In this embodiment, pegs 18 are omitted. Securing hooks 22 are disposed on sheet metal plates 31, and function in the manner previously described.

Figure 8:
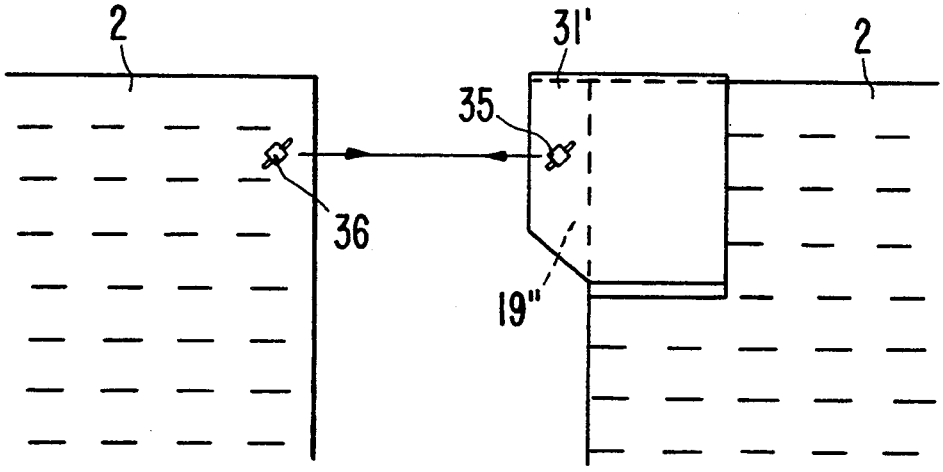
FIG. 8 is an exploded partial plan view of an alternate embodiment of the connection between two adjacent deck slabs of the present invention.

Referring to FIG. 8, another embodiment of deck slab 2 is shown. Similar to the embodiment shown in FIG. 7, a pair of metal plates 31' are fastened to opposite surfaces of deck slab 2, so as to sandwich deck slab 2 therebetween. Each pair of metal plates 31' extends beyond the deck slab in the longitudinal direction of the bridge, forming a lower flange pocket 19''. In this embodiment, each lower flange pocket 19'' is penetrated by a keyhole aperture 35 with lateral or eccentric recesses. The adjacent deck slab is penetrated by a corresponding keyhole aperture 36. Each keyhole aperture 35 and 36 is essentially perpendicular to lower flange pocket 19''. When assembling two adjacent deck slabs together, the corner of the deck slab with aperture 36 is slidingly inserted into flange pocket 19'' until the keyhole aperture 35 of flange pocket 19'' and the corresponding keyhole aperture bore 36 are coaxially located. As in the previously discussed embodiment, pegs 18 are omitted. However, in the present embodiment, securing hooks 22 are also omitted. To lock the truss to the deck slabs, truss 1 is provided with a connecting bolt (not shown) having at one point a hammerlike head or end with a cross sectional shape corresponding to keyhole apertures 35 and 36. When the bolt is inserted into keyhole apertures 35 and 36 and the truss is pivoted in the manner previously discussed, the end of the bolt becomes wedged or locked within the plates 31' thus locking the truss, and the two adjacent deck slabs together.

Figure 9:
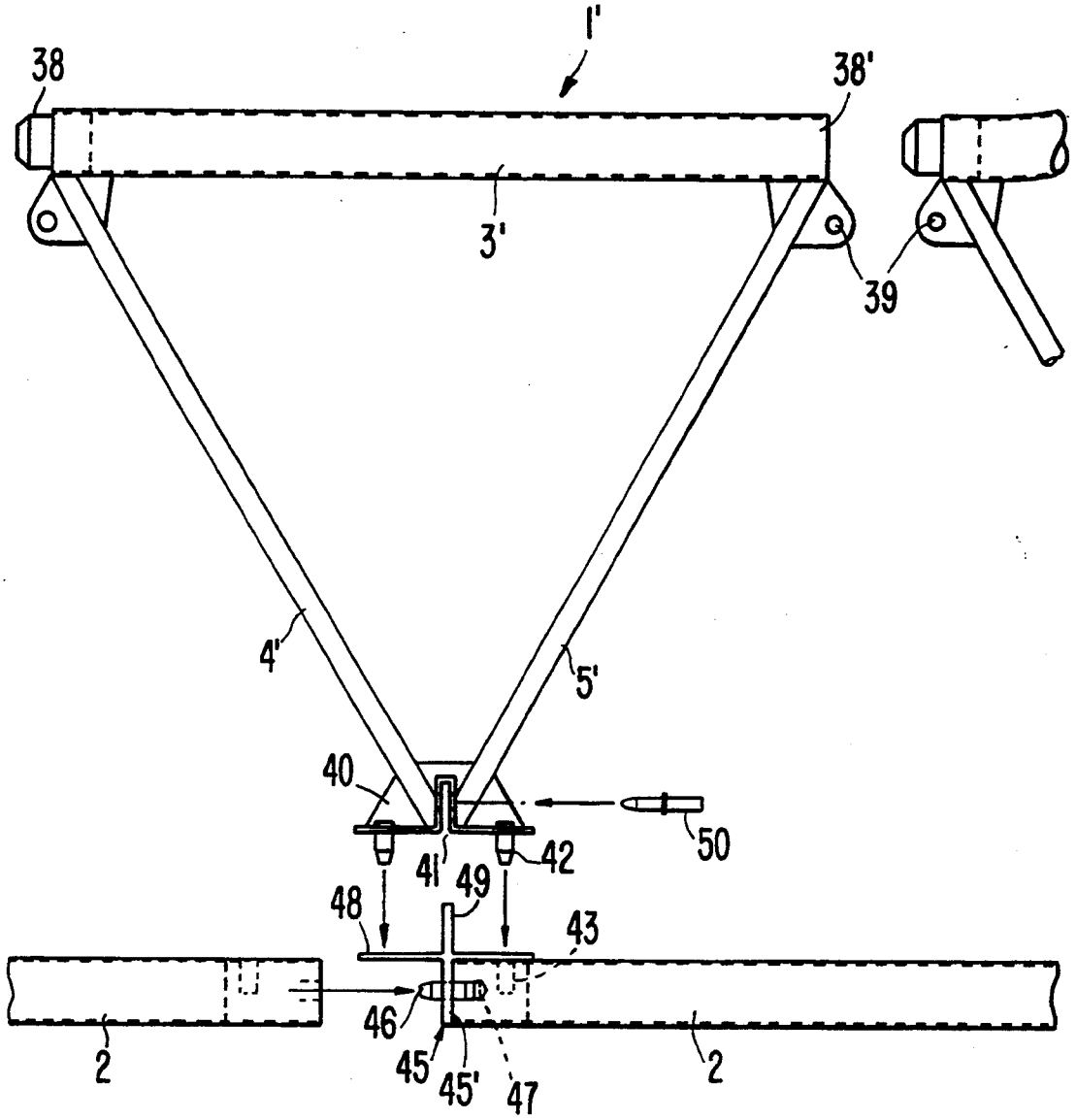
FIG. 9 is an exploded side elevational illustration of an alternate embodiment of the bridge sections of the present invention.

FIG. 9 illustrates an alternative embodiment wherein a triangular truss 1' has a top beam 3' in the form of a pipe. Top beam 3' has a peg end 38 and an opposite hollow end 38'. Peg end 38 fits into hollow end 38' of an adjacent triangular truss 1'. Triangular truss 1' further includes securing eyes 39 in the region of peg end 38 and hollow end 38' through which a securing bolt (not shown) is fastened during assembly.

Triangular truss 1' has diagonal legs or struts 4', 5' that are brought together at a fork-shaped cap 40 having a perpendicular recess 41. Cap 40 has two downwardly projecting pegs 42, which are insertable into corresponding bores 43 in the corners of adjacent deck slabs 2. A cross-shaped adapter piece 45 has a horizontal bar 48, an upper bar 49 and a double bolt 46 on a lower vertical leg 45' for engagement with corresponding bores 47 in adjacent edge faces of adjoining deck slabs 2.

When assembling a bridge in accordance with this embodiment, two deck slabs 2 are pushed together. Adapter piece 45 is supported between the adjacent deck slabs by its horizontal bars 48, which slide over tracks 14. Once the adjacent deck slabs are pushed together, double bolt 46 is located within corresponding bores 47. Subsequently, triangular truss 1' is lowered, so that pegs 42 enter corresponding bores 43 and upper bar 49 of adapter piece 45 slides into recess 41 of cap 40. Cap 40 is secured to upper bar 49 by a bolt 50. Bolt 50 can be connected with triangular truss 1' by a chain (not shown).

The invention now being fully described, it will be apparent to one of ordinary skill in the art that any changes and modifications can be made thereto without departing from the spirit or scope of the invention as set forth herein.

What is claimed is:

1. A transportable bridge having longitudinal sides, comprising:

a plurality of bridge sections connected in series and presenting first and last bridge sections in the series, each said bridge section in the series including:

a deck slab extending across a width of the bridge and having front and rear transverse ends; and an inverted triangular truss on each longitudinal side of the bridge, each said truss having a lower corner portion and an oppositely disposed top beam, said lower corner portion of said truss being connected to the rear transverse end of said deck slab and additionally connected to the front transverse end of the deck slab of an adjacent following bridge section in said series of bridge sections, and the top beam of the truss of said bridge section being connected to the top beam of said adjacent following bridge section, thus forming a trough-shaped bridge having a lateral truss structure;

a further deck slab associated with said last bridge section; and diagonal struts connected, respectively, between the top beams of the trusses of said first and last bridge sections and the deck slabs associated with said first and last bridge sections for closing off said trusses.

2. A transportable bridge as defined in claim 1, further comprising interlocking connections for releasably connecting together the deck slabs and said trusses.

3. A transportable bridge as defined in claim 2, wherein said top beam of each said truss has one end including a hammer-shaped projection and an opposite end including a pocket for receiving the hammer-shaped projection of the one end of the top beam of the truss of said following bridge section for interlockingly connecting together the top beams of adjacent trusses.

4. A transportable bridge as defined in claim 3, further comprising a pivotal clamp hinged to one end of the top beam of each said truss for locking said hammer-shaped projection within said pocket.

5. A transportable bridge as defined in claim 2, wherein said interlocking connections each comprise:

at least one downwardly projecting peg-like element on the lower corner portion of the respective trusses; and a securing device extending perpendicularly to said peg-like element for coupling together the rear transverse end of one deck slab with the front transverse end of the adjacent following deck slab, said securing device including a bore for receiving said peg-like element.

6. A transportable bridge as defined in claim 5, wherein said securing device includes means defining a recess on one of the rear transverse end of said one deck slab and the front transverse end of said adjacent following deck slab for receiving the other of said transverse ends, said recess extending in a direction perpendicular to said bore.

7. A transportable bridge as defined in claim 5, wherein said securing device includes an adapter plate containing said bore and disposed intermediate to said truss and adjacent deck slabs.

8. A transportable bridge as defined in claim 5, wherein said interlocking connection includes means for locking a releasable interlocking connection by rotating said truss around a longitudinal axis of said peg-like element.

9. A transportable bridge as defined in claim 8, wherein said interlocking connection includes a flange on the lower corner portion of said truss and a securing hook disposed on said deck slab for interlockingly engaging with said flange when said truss is rotated.

10. A transportable bridge as defined in claim 8, wherein said means requires approximately a 45° turn of said truss element about the longitudinal axis of said peg-like element.

11. A transportable bridge as defined in claim 1, wherein each said deck slab includes a track area and is planar only in said track area.

12. A transportable bridge as defined in claim 11, wherein said deck slab includes a curb piece having one end hinged to said deck slab at a level of said track area and a second end projectable above a level of said track area.

* * * * *